US005435742A

United States Patent [19]

Cecil, Jr.

[11] Patent Number: 5,435,742

[45] Date of Patent: Jul. 25, 1995

[54] ELECTRICAL CONNECTOR POSITION ASSURANCE SYSTEM

[75] Inventor: Paul D. Cecil, Jr., Joliet, Ill.

[73] Assignee: Molex Incorporated, Lisle, Ill.

[21] Appl. No.: 195,723

[22] Filed: Feb. 14, 1994

[51] Int. Cl.[6] ..... H01R 4/50

[52] U.S. Cl. ..... 439/347; 439/489

[58] Field of Search ..... 439/345, 347, 350, 352, 439/488, 489

[56] References Cited

U.S. PATENT DOCUMENTS

| | | | |
|---|---|---|---|
| 4,412,714 | 11/1983 | Morningstar et al. | 439/352 |
| 4,867,699 | 9/1989 | Oda et al. | 439/355 |
| 4,906,203 | 3/1990 | Margrave et al. | 439/188 |
| 4,978,311 | 12/1990 | Oda et al. | 439/188 |
| 5,064,973 | 11/1991 | Zinn et al. | 200/51.1 |
| 5,178,547 | 1/1993 | Bonas et al. | 439/34 |
| 5,192,225 | 3/1993 | Suzuki | 439/489 |
| 5,236,373 | 8/1993 | Kennedy | 439/352 X |
| 5,254,013 | 10/1993 | Tanaka | 439/352 |
| 5,314,345 | 5/1994 | Cahaly et al. | 439/352 X |
| 5,318,457 | 6/1994 | Harting et al. | 439/352 |

*Primary Examiner*—Khiem Nguyen
*Attorney, Agent, or Firm*—A. A. Tirva

[57] ABSTRACT

An electrical connector assembly includes a first connector having a first mating portion and a second connector having a second mating portion mateable with the first mating portion of the first connector. The second connector includes a projection which is at a first location when the connectors are fully mated and which is at a second location when the connectors are less than fully mated. A connector position assurance device is movably mounted on the first connector for movement between a first position and a second position. The projection blocks movement of the device to its second position when the projection is in its second location. The device includes a final latch for holding the connectors in mated condition when the device is in its second position.

5 Claims, 7 Drawing Sheets

ELECTRICAL CONNECTOR POSITION ASSURANCE SYSTEM

FIELD OF THE INVENTION

This invention generally relates to the art of electrical connectors and, particularly, to a system for assuring the position of a pair of mating connectors, particularly assuring that the connectors are fully mated.

BACKGROUND OF THE INVENTION

There are a variety of applications wherein it is desirable to assure that a pair of electrical connecting devices are properly mated or securely latched. In other words, it is desirable to detect whether the connectors are properly or improperly fitted together. This assurance is desirable not only in the initial interconnection of the connectors, but in applications where the connectors are exposed to vibrations and may become disconnected.

For instance, one approach to assuring that connectors remain connected is to design the connectors with a high mating force which, in turn, results in a high unmating force. This approach is highly undesirable in applications wherein the connectors must be disconnected for inspection or servicing. On the other hand, reducing the mating forces of the connector assembly, in turn, reduces the unmating forces which is undesirable in many applications. In fact, the risk of unmated connectors can be life-threatening in some applications, such as in the electrical interconnections of a safety airbag of a motor vehicle.

The present invention is directed to solving these problems by providing a simple and very effective system for assuring proper positioning or mating of a pair of electrical connectors.

SUMMARY OF THE INVENTION

An object, therefore, of the invention is to provide a new and improved connector position assurance system for assuring or detecting that a pair of connectors are properly mated or securely latched.

In the exemplary embodiment of the invention, an electrical connector assembly is disclosed with a plug connector having a housing and a mating plug portion. A socket connector is provided for receiving the mating plug portion of the plug connector.

The invention contemplates a connector position assurance system wherein a connector position assurance device is movably mounted on the plug connector for movement between a first position allowing mating of the connectors and a second position latching the connectors in fully mated condition. A projection on the socket connector is located in a recess in the plug connector when the connectors are fully mated. The projection is located outside the recess when the connectors are less than fully mated. The projection blocks movement of the connector position assurance device when the projection is located outside the recess.

Generally, complementary interengaging preliminary latch means are provided between the connector position assurance device and the plug connector to hold the device in its first position. Complementary interengaging final latch means are provided between the connector position assurance device and the plug connector to hold the device in its second position.

As disclosed herein, the socket connector has a generally cylindrical portion, and a pair of the aforesaid projections are provided in the form of ears projecting radially outwardly on diametrically opposite sides of the cylindrical portion. The connector position assurance device embraces a substantial portion of the plug connector and is slidable thereon between its first and second positions. The device includes a slot for accommodating the generally cylindrical portion of the socket connector. The slot is formed on two sides by flanges of the device, and the ears are located in the path of the flanges to block movement of the device when the ears are not in their respective recesses of the plug connector.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
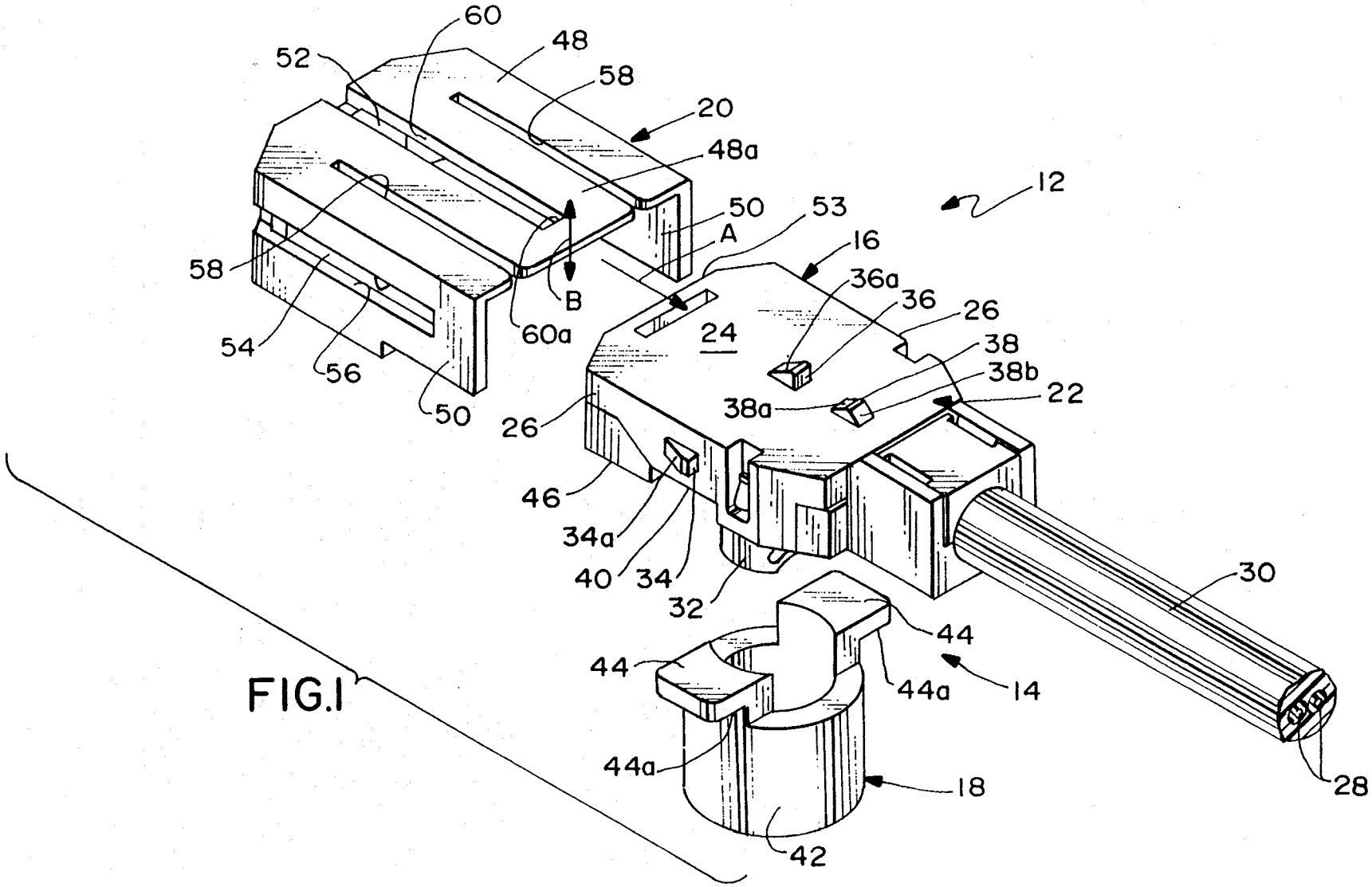
FIG. 1 is an exploded perspective view of an electrical connector assembly incorporating the connector position assurance system of the invention.

Referring to the drawings in greater detail, and first to FIG. 1, the connector position assurance system of the invention, generally designated 12, is incorporated in an electrical connector assembly, generally designated 14. The connector assembly includes a first or plug connector, generally designated 16, and a second or socket connector, generally designated 18. The connector position assurance system includes a connector position assurance device, generally designated 20, slidably or movably mounted on plug connector 16, as fully described hereinafter.

More particularly, first or plug connector 16 includes a housing, generally designated 22, having a top wall 24 and a pair of opposite side walls 26 which house appropriate electrical terminals (not shown) terminated to the conductors 28 of an electrical cable 30. The plug connector has a mating plug portion 32 projecting from the bottom thereof. A guide boss 34 having a ramped guide surface 34*a* projects laterally outwardly from each side wall 26. A preliminary latch boss 36, having a ramped surface 36*a*, projects upwardly from top wall 24 of housing 22. A final latch boss 38, having ramped surfaces 38*a* and 38*b*, also projects upwardly from top wall 24. Lastly, a recess 40 is formed on the underside of plug connector housing 22 whereby the recess opens downwardly of the connector. The purposes and/or functions of guide boss 34, preliminary latch boss 36, final latch boss 38 and recesses 40 will be described hereinafter.

Second or socket connector 18 includes a cylindrical portion 42 having a pair of projections 44 on diametrically opposite sides of the cylindrical portion at the top thereof. It can be seen that the projections are in the form of flat ears projecting outwardly from opposite sides of the socket connector. The projections are sized for fitting into recesses 40 in the underside of plug connector housing 22 as the two connectors are mated. The thicknesses of the projections are substantially equal to the depths of recesses 40 so that the bottom surfaces 44*a* of the projections are generally flush with a bottom surface 46 of plug connector housing 22 when the two connectors are fully mated. Socket connector 18 houses appropriate terminal means, not shown, for mating with appropriate terminal means of plug connector 16.

Connector position assurance device 20 is sort of box-shaped for mounting onto plug connector housing 22 in a sliding manner, as indicated by arrow "A" in FIG. 1. The device is unitarily molded of dielectric material, such as plastic or the like, and includes a top wall 48, a pair of side walls 50, a rear wall 52 which is irregularly shaped and corresponding to a rear wall 53 of plug connector housing 22, and a partial bottom wall 54 of a shape which will be clearly seen hereinafter. Each side wall 50 has a guide slot 56 which receives guide boss 34 of the plug connector when the device is slidably mounted thereon. In particular, the front of each side wall 50 rides over the ramped guide surface 34*a* of the respective guide boss 34, and the side wall snaps back into a position against the respective side wall 26 of plug connector housing 22, with the guide boss positioned in slot 56 (see FIG. 2).

Top wall 48 of connector position assurance device 20 has a tongue portion 48*a* defined by a pair of elongated cut outs 58, whereby the tongue is resiliently flexible in the direction of double-headed arrow "B". A latch boss receiving slot 60 is formed in tongue 48*a*, with the front of the slot being closed to define a latching surface 60*a*. When connector position assurance device 20 is mounted or assembled onto plug connector housing 22, the front of tongue 48*a* of the device rides upwardly over ramped surface 36*a* of preliminary latch boss 36 until latch surface 60*a* reaches the front of the boss, whereupon the resiliently flexible tongue snaps down into a preliminary latching position as shown in FIG. 2.

In other words, the initial step of assembly is to slidably mount connector position assurance device 20 onto plug connector housing 22 in the direction of arrow "A" (FIG. 1). The connector position assurance device initially reaches a first, preliminary position as shown in FIG. 2, which could be considered a "preload" position. In this position, it should be understood that the device does not block recesses 40 on the underside of plug connector housing 22.

Figure 2:
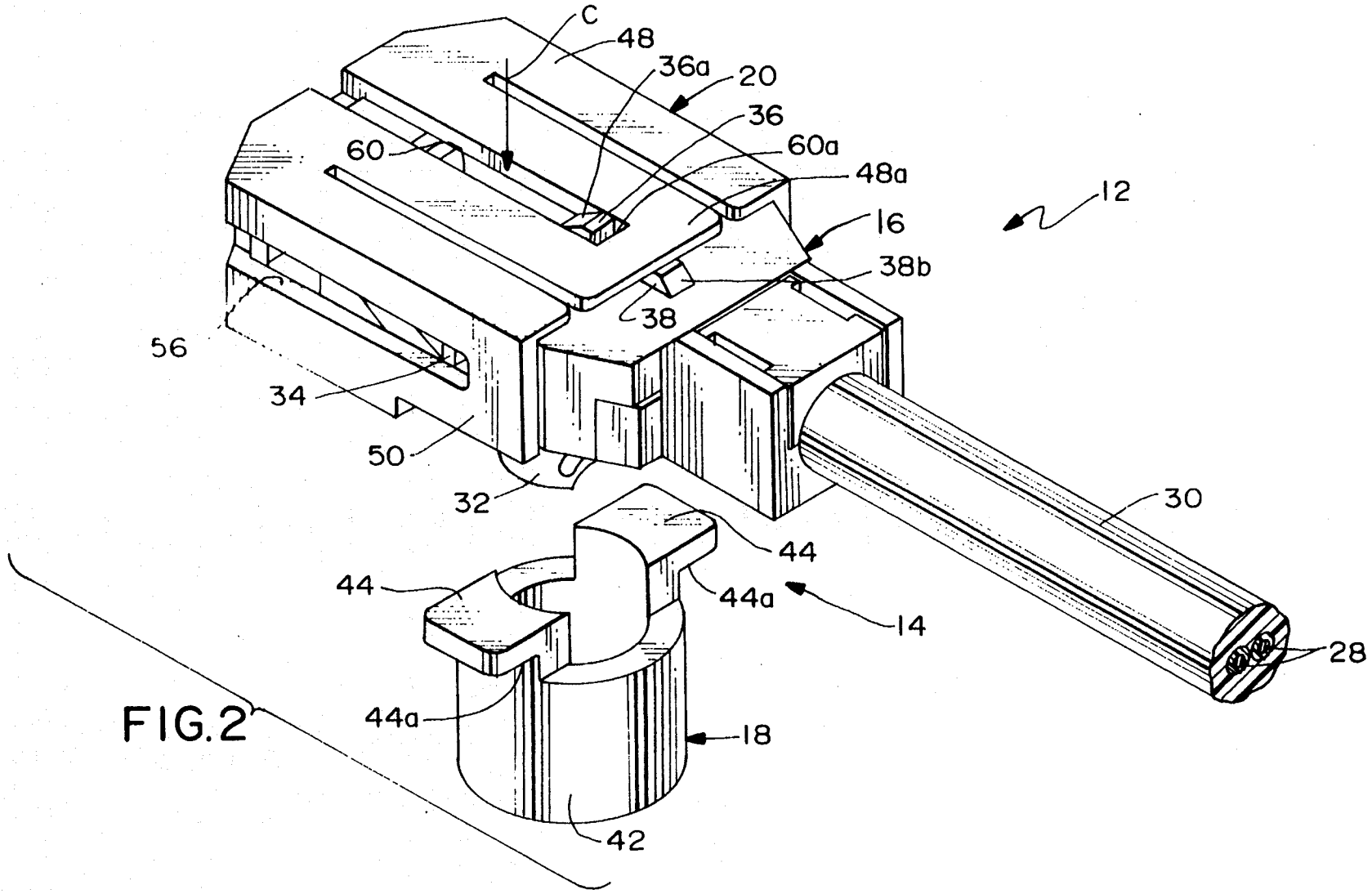
FIG. 2 is a view similar to that of FIG. 1, with the connector position assurance device mounted on the plug connector, but with the plug connector unmated from the socket connector.
Figure 3:
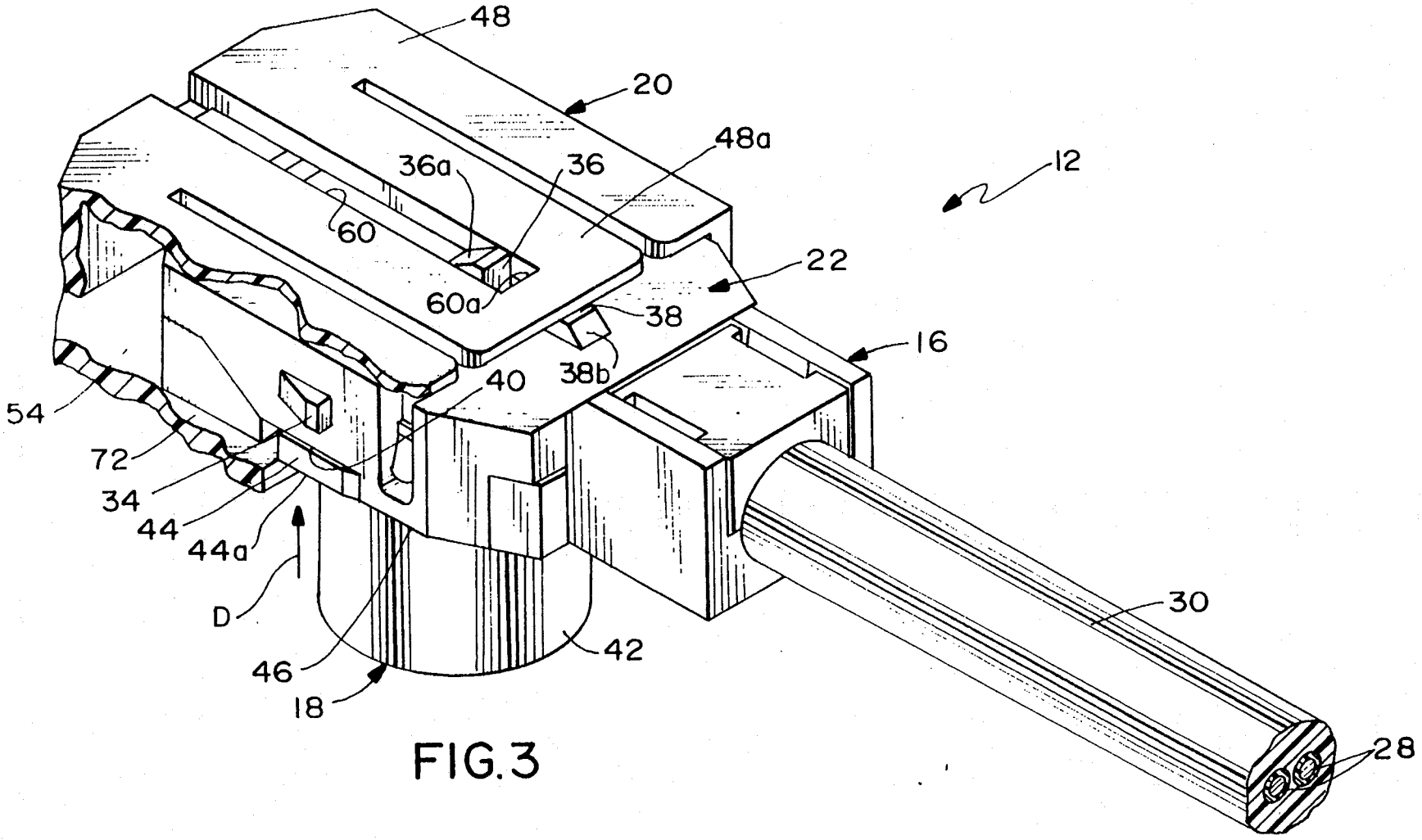
FIG. 3 is a view similar to that of FIG. 2, partially cut away, with the two connectors mated but with the connector position assurance device in its preliminary position.

Referring to FIGS. 2 and 3, plug connector 16, with connector position assurance device 20 preliminarily mounted thereon, then can be mated with socket connector 18 in the direction of arrow "C". The connectors are shown in FIG. 3 in a fully mated condition. In this condition, it can be seen how projections 44 are fully received in recesses 40 on the underside of plug connector housing 22, with the bottom surfaces 44*a* of the projections flush with bottom surface 46 of the plug connector housing. FIG. 3 also shows that connector position assurance device 20 still is in its preliminary or preload position and is held in that position by preliminary latch boss 36. Lastly, it can be seen in FIG. 3 how "partial" bottom wall 54 of the connector position assurance device allows a free path for projections 44 of socket connector 18 to enter recesses 40 of plug connector 16 in the direction of arrow "D".

Figure 4:
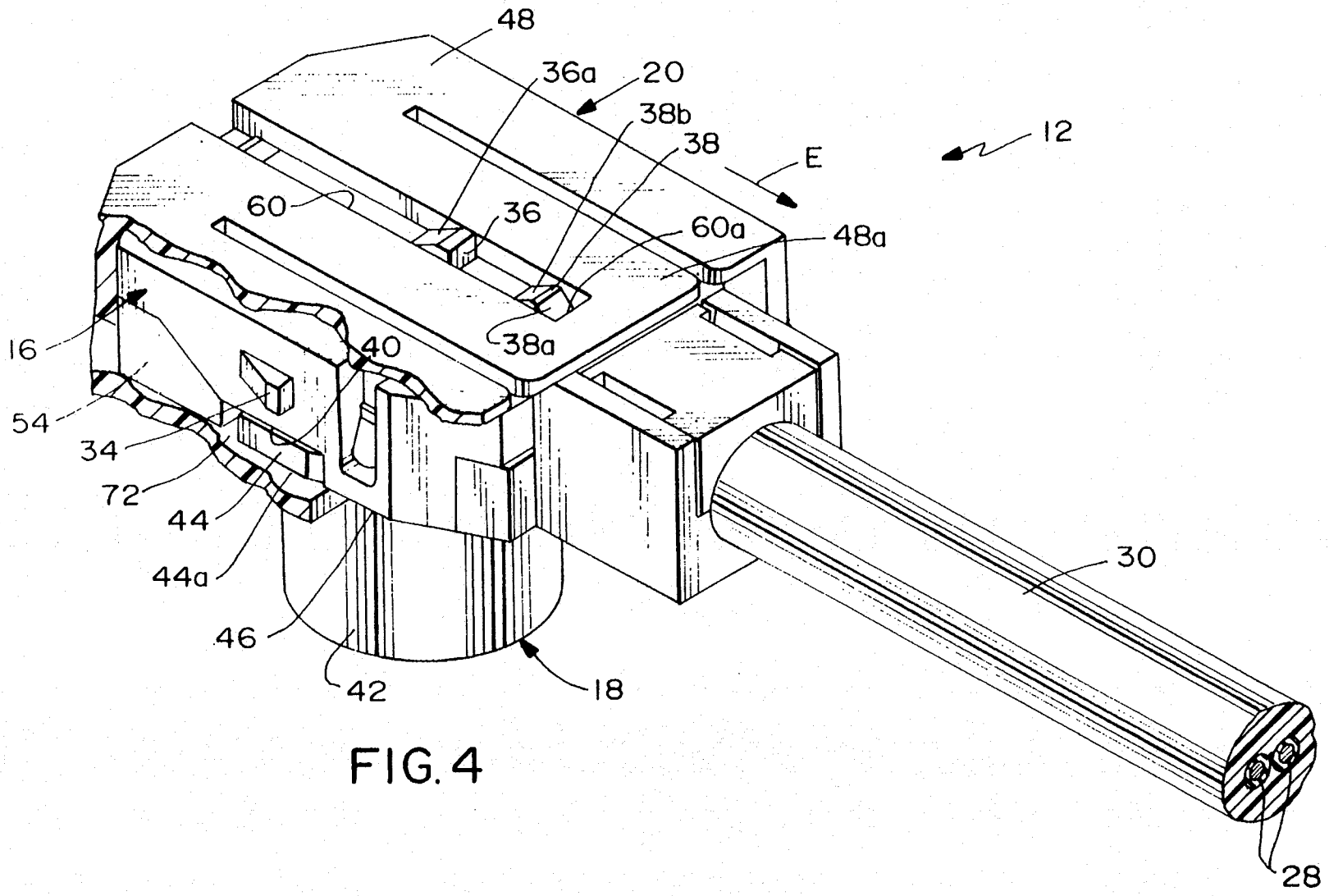
FIG. 4 is a view similar to that of FIG. 3, with the connector position assurance device in its final latching position.

FIG. 4 shows the final condition of connector position assurance system 12, with plug connector 16 and socket connector 18 fully mated, and with terminal position assurance device 20 in its final latched position. More particularly, it can be seen in FIG. 4 that the terminal position assurance device has been moved forwardly in the direction of arrow "E" from the position shown in FIG. 3 to a position wherein latch surface 60*a* of slot 60 has moved over latch boss 38 and into a latching position in front thereof. In this final position, it can be seen that partial bottom wall 54 of the position assurance device now has moved under projections 44 of socket connector 18. The socket connector now cannot be unmated from the plug connector, regardless of whether or not the connectors are designed with a small unmating force. In other words, for inspection, servicing and/or replacement purposes, the connectors can be designed with a rather small and convenient unmating force, because connector position assurance device 20 latches and holds the connectors in their fully mated position.

With the above description and understandings, it can be seen that connector position assurance device 20 also acts as a detecting device to an operator for indicating that the connectors are not quite fully mated under any circumstances. In other words, should the connectors be only partially mated, projections 44 of socket connector 18 will not be fully inserted into recesses 40 of plug connector 16. The projections, therefore, will block movement of the position assurance device to its final position by blocking partial bottom wall 54 of the device. Of course, once the assurance device is moved to its final position, the device, in turn, blocks withdrawal of the projections of the socket connector from the recesses of the plug connector.

Lastly, final latch boss 38 can be designed to determine the amount of forces required to move connector position assurance device 20 out of its final position to permit unmating of the connectors. Specifically, it can be seen that boss 38 is formed with ramped surfaces 38*a* and 38*b* on opposite sides thereof. Of course, ramped surface 38*a*, like ramped surface 36*a* of preliminary latch boss 36, is provided for facilitating easy movement of the position assurance device to its two positions. However, ramped surface 38*b* of boss 38 could be made more abrupt to be more like preliminary boss 36. With such a construction, tongue 48 would have to be physically lifted in order for latch surface 60*a* to clear boss 38 and allow the position assurance device to be moved back to its preliminary position to permit unmating of the connectors. Boss surface 38*b* has been designed, as shown, to be ramped or inclined so that assurance device 20 can be moved opposite arrow "E" (FIG. 4) simply by pulling rearwardly on the device. The inclination of boss surface 38*b* determines the amount of force required for rearwardly moving the assurance device.

Figure 5:
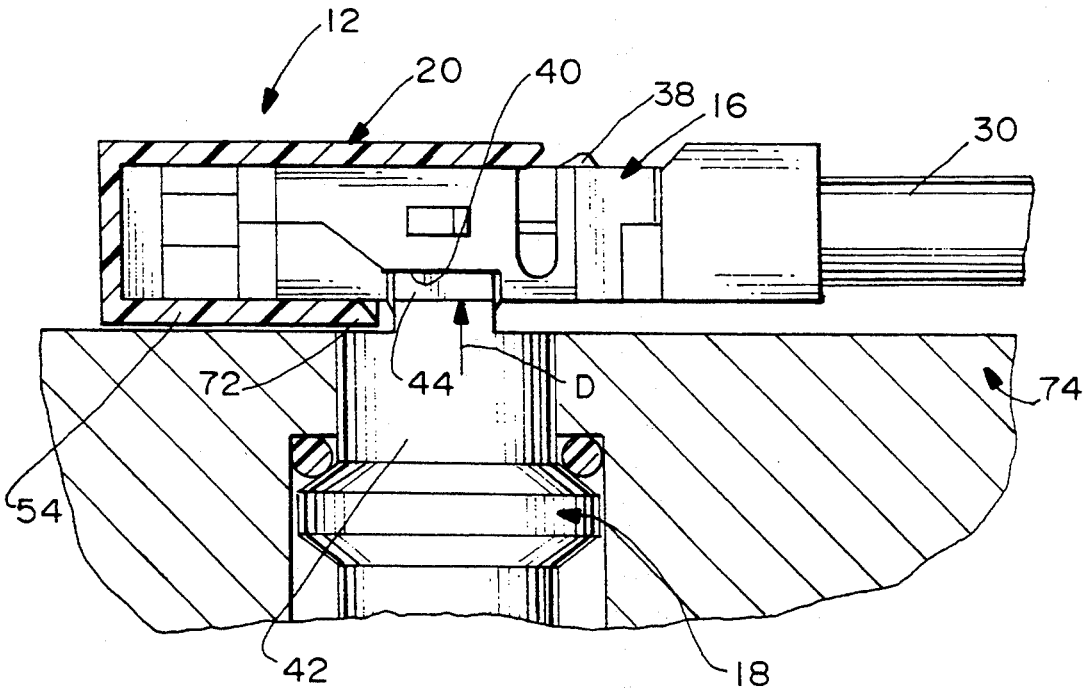
FIG. 5 is a vertical section through the connector position assurance device, the assembly being in the preliminary position corresponding to FIG. 3.
Figure 6:
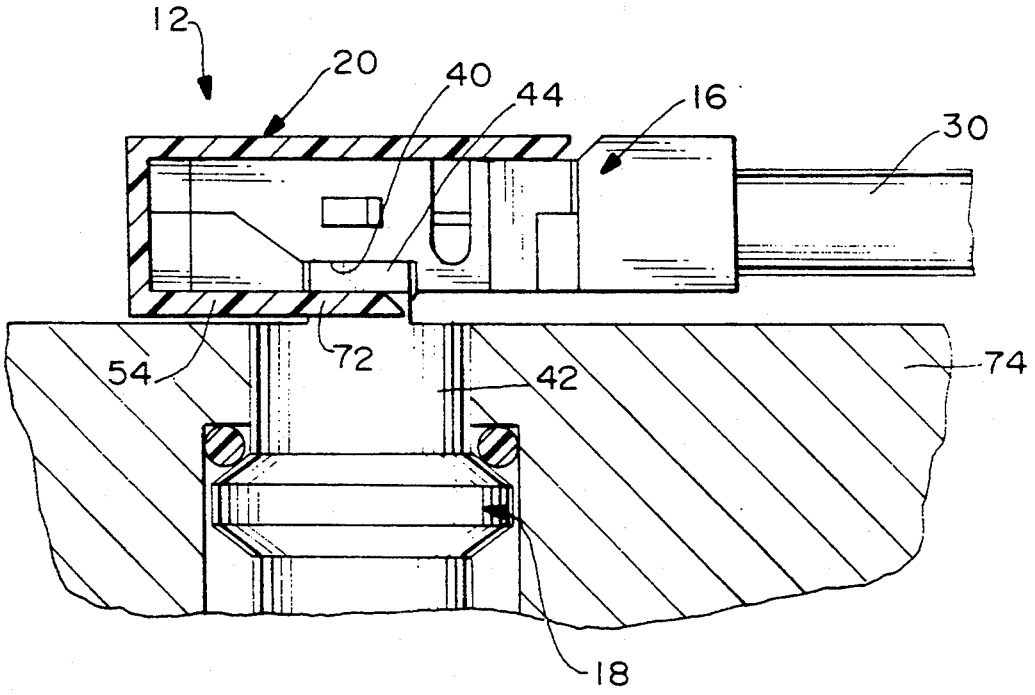
FIG. 6 is a view similar to that of FIG. 5, but with the assembly in final condition corresponding to FIG. 4.

The sectional views shown in FIGS. 5 and 6 (which correspond positionally to FIGS. 3 and 4, respectively) clearly show how bottom wall 54 of connector position assurance device 20 allows for projections 44 of socket connector 18 to enter recesses 40 of plug connector 16 in the direction of arrow "D" in FIG. 5. However, once the assurance device is moved to its final position, FIG. 6 shows quite clearly how bottom wall 54 substantially closes recesses 40 and prevents removal of projections 44 therefrom and, thereby, prevents unmating of the connectors.

Figure 7:
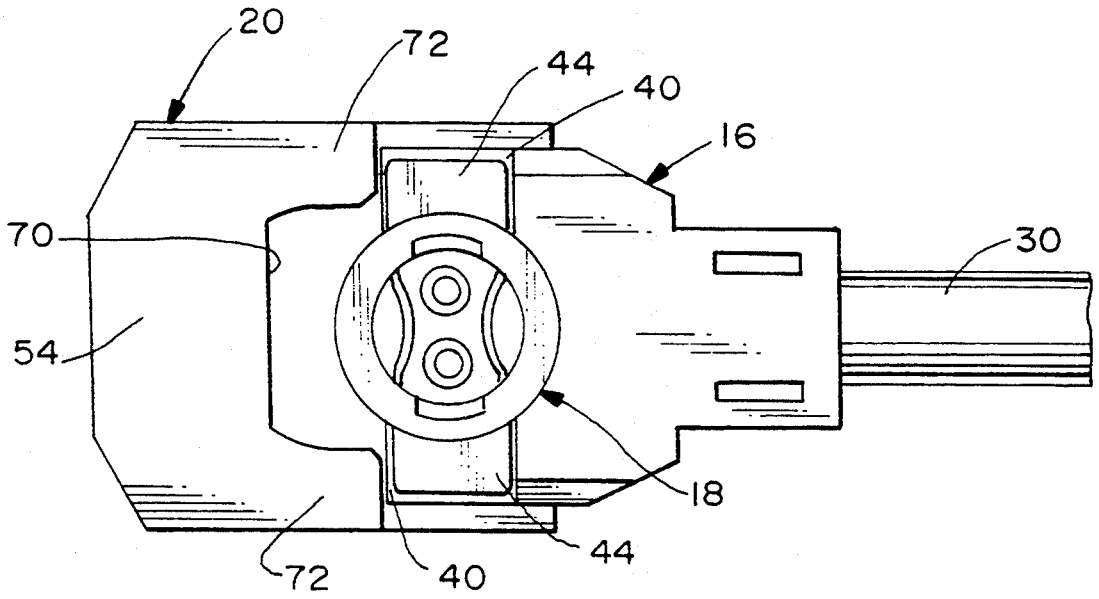
FIG. 7 is a bottom view of the assembly in the preliminary position of FIG. 5.
Figure 8:
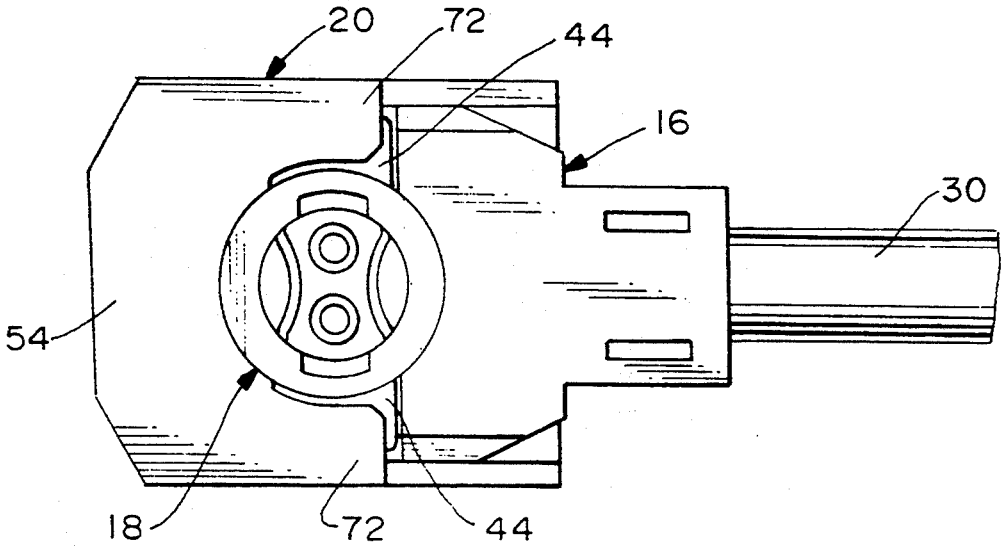
FIG. 8 is a view similar to that of FIG. 7, with the assembly in the final condition of FIG. 6.

FIGS. 7 and 8 correspond positionally to the depictions of FIGS. 5 and 6, respectively. FIGS. 7 and 8 show that partial bottom wall 54 is provided with a slot or cutout 70 defining a pair of flange portions 72 of bottom wall 54. Slot 70 accommodates socket connector 18 when connector position assurance device 20 is moved from its preliminary or preload position shown in FIG. 7 to its final position shown in FIG. 8. The flange portions 72 of partial bottom wall 54, therefore, are the parts of the bottom wall which actually block movement of projections 44 of the socket connector out of recesses 40 of the plug connector, thereby preventing unmating of the connectors.

Figure 9:
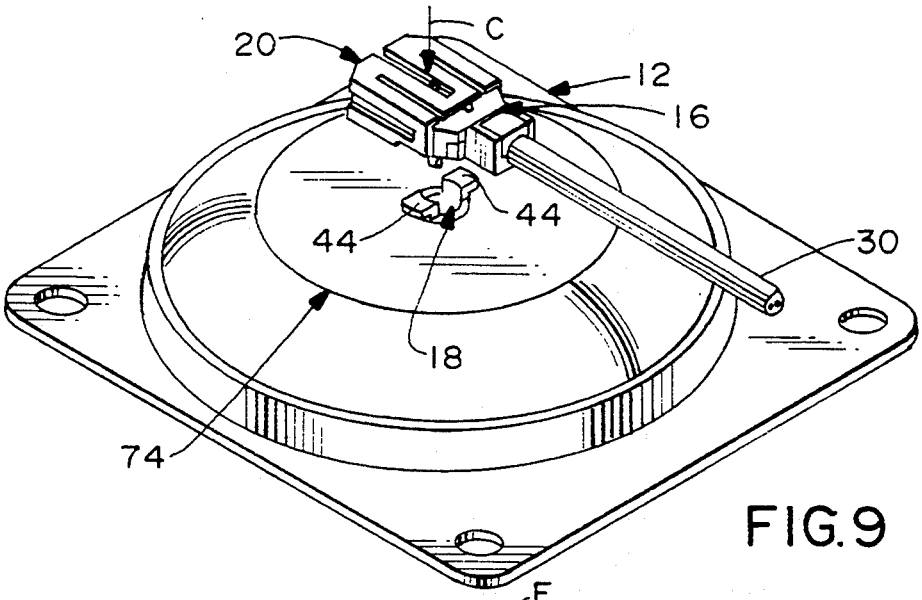
FIG. 9 is a perspective view of the assembly as applied in an airbag connector application, with the assembly corresponding to the condition shown in FIG. 2.
Figure 10:
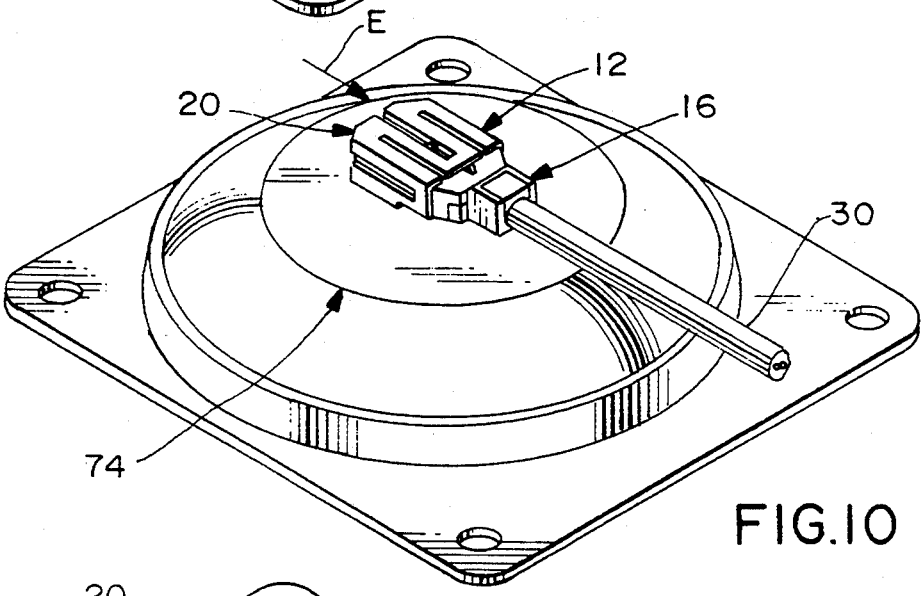
FIG. 10 is a view similar to that of FIG. 9, but with the assembly corresponding to the preliminary position of FIG. 3.
Figure 11:
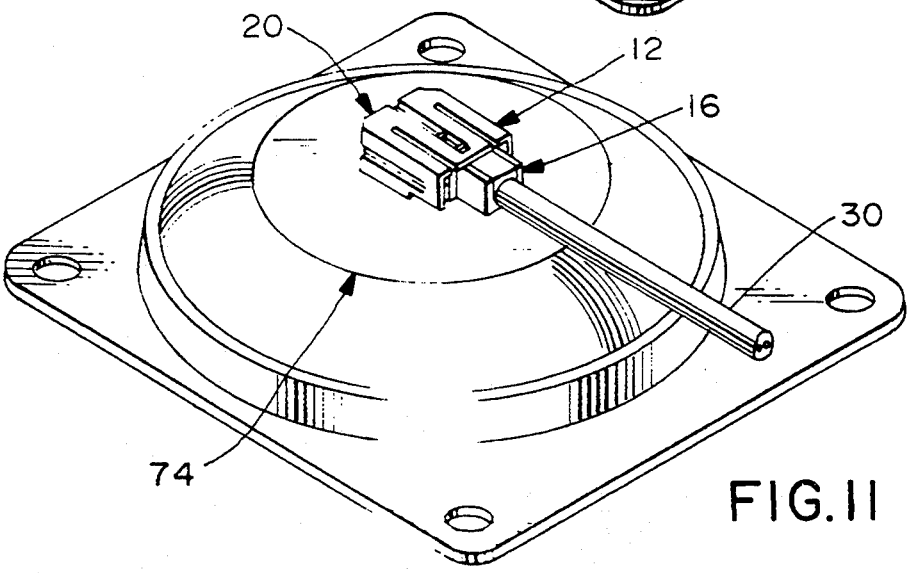
FIG. 11 is a view similar to that of FIGS. 9 and 10, but with the assembly in the final condition corresponding to that of FIGS. 4, 6 and 8.

Lastly, FIGS. 9–11 show an application of the connector position assurance system 12 of the invention, wherein the assurance of proper mating of a pair of connectors is quite critical. In particular, socket connector 18 is shown mounted on an airbag assembly 74 for a motor vehicle. Plug connector 16 and cable 30 are electrically coupled to the power and control circuitry of the vehicle. FIG. 9 corresponds positionally to the condition of the system shown and described above in relation to FIG. 2. In other words, plug connector 16 is about to be moved downwardly in the direction of arrow "C" into mated engagement with socket connector 18. Connector position assurance device 20 is mounted on the plug connector, but the device in its first or preliminary position allowing mating of the two connectors.

FIG. 10 shows the system corresponding positionally to FIGS. 3, 5 and 7 described above. In other words, the connectors are mated, but position assurance device 20 still is in its preliminary or preload position. Once the devices are fully mated, the assurance device can be moved in the direction of arrow "E" to the final, fully mated and latched condition of the system as shown in FIG. 11 which corresponds positionally to FIGS. 4, 6 and 8 as described above.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

I claim:

1. In an electrical connector assembly which includes
   - a plug connector having a housing and mating plug portion, and
   - a socket connector for receiving the mating plug portion of the plug connector,
   - wherein the improvement comprises a connector position assurance system which includes
   - a connector position assurance device movably mounted on the plug connector for movement between a first position allowing mating of the connectors and a second position latching the connectors in fully mated condition, and
   - a projection on the socket connector which is located in a recess in the plug connector when the connectors are fully mated, the projection being located outside the recess when the connectors are less than fully mated, and the projection blocking said movement of the connector position assurance device when the projection is located outside the recess.

2. In an electrical connector assembly as set forth in claim 1, wherein said socket connector has a generally cylindrical portion and a pair of said projections are provided in the form of ears projecting radially outwardly on generally diametrically opposite sides of the cylindrical portion.

3. In an electrical connector assembly as set forth in claim 1, including complementary interengaging preliminary latch means between the connector position assurance device and the plug connector to hold the device in its first position.

4. In an electrical connector assembly as set forth in claim 1, including complementary interengaging final latch means between the connector position assurance device and the plug connector to hold the device in its second position.

5. In an electrical connector assembly as set forth in claim 1, wherein said connector position assurance device embraces a substantial portion of the plug connector and is slidable thereon between said positions, the device including a slot for accommodating the socket connector, the slot being formed at least in part by a flange of the device, and the projection of the socket connector being in the path of the flange to block movement of the device unless the connectors are fully mated.

* * * * *